US006041981A

United States Patent [19]

Fleckenstein et al.

[11] Patent Number: 6,041,981

[45] Date of Patent: Mar. 28, 2000

[54] FLEXIBLE FOLD-OVER CONTAINER SEAL

[76] Inventors: Christoph Fleckenstein; Anja Goetz, both of Wangenheimstrasse 38A, 14193 Berlin, Germany

[21] Appl. No.: 09/051,072

[22] PCT Filed: Oct. 2, 1996

[86] PCT No.: PCT/DE96/01893

§ 371 Date: Apr. 2, 1998

§ 102(e) Date: Apr. 2, 1998

[87] PCT Pub. No.: WO97/13702

PCT Pub. Date: Apr. 17, 1997

[30] Foreign Application Priority Data

Oct. 6, 1995 [DE] Germany ..... 195 37 221

[51] Int. Cl.[7] ..... B67D 3/00

[52] U.S. Cl. ..... 222/533; 222/532; 222/528; 220/375

[58] Field of Search ..... 222/528, 532, 222/533, 498, 546, 556; 215/228, 295, 806, 303; 220/839, 233, 375

[56] References Cited

U.S. PATENT DOCUMENTS

| | | | |
|---|---|---|---|
| 1,949,058 | 2/1934 | Leguillon | 222/529 |
| 1,959,206 | 5/1934 | Hartog . | |
| 2,921,716 | 1/1960 | Schiller . | |
| 3,260,425 | 7/1966 | Moran | 222/563 |
| 3,366,285 | 1/1968 | Scislowicz | 222/529 |
| 3,422,997 | 1/1969 | Anderson . | |
| 4,386,720 | 6/1983 | Speedie . | |
| 5,358,154 | 10/1994 | Halm | 222/529 X |

FOREIGN PATENT DOCUMENTS

| | | | |
|---|---|---|---|
| 00 81 124 | 6/1983 | European Pat. Off. . | |
| 00 40 615 | 4/1987 | European Pat. Off. . | |
| 2 603 171 | 5/1987 | France . | |
| 71 22 745 | 6/1971 | Germany . | |
| 30 01 835 | 1/1980 | Germany . | |
| 35 22 227 | 2/1987 | Germany | 222/528 |
| 39 26 875 | 8/1989 | Germany . | |
| 40 28 781 | 9/1990 | Germany . | |
| 42 12 693 | 4/1992 | Germany . | |
| 427 631 | 12/1966 | Switzerland . | |
| 6 82 143 | 7/1993 | Switzerland . | |
| 81 01 544 | 11/1980 | WIPO . | |
| 93 11 049 | 12/1992 | WIPO . | |

*Primary Examiner*—Kevin Shaver
*Assistant Examiner*—Thach Bui
*Attorney, Agent, or Firm*—Paul Vincent

[57] ABSTRACT

The proposal is for a container closure with a closure head (4) having a pivoted coupling (3) and an outlet aperture (6) as well as a closing component (7), in which, in the closed position, the closing head is clipped over the container aperture and its closing component (7) seals its opening (2), while in the open position, the outlet aperture is pivoted towards the opening.

11 Claims, 1 Drawing Sheet

FLEXIBLE FOLD-OVER CONTAINER SEAL

BACKGROUND OF THE INVENTION

The invention concerns a container closure for a container suitable for accepting liquids, creams, or pourable materials, with a closure head made from plastic to open and close the container, a container aperture having an opening, a closing component of the closure head cooperating with the opening, and a pivoted coupling for the closing component. This type of plastic container is produced in a variety of different embodiments for cosmetic products, for food products and for technical applications. It is thereby important for the material to be kept in the container to be removed therefrom, in particular, in a natural fashion. The invention is also based on a type of container with which, due to the elasticity of the container wall, the material being contained can be pressed out via pressure applied to the container. The container closure with which the invention is concerned is therefore not restricted to small containers, rather extends both to tubes as well as to large containers. The container can be emptied via a container opening, wherein the container opening is directly disposed on the container or can simply be attached to same, e.g. by means of screwing, frictional fit or the like. Independent thereof, this container opening ends in a portion cooperating with the closure component of the closure head to close same. Whereas the closure head and container can be made from different materials, the components of the closure head including the pivoted coupling are preferentially made from the same plastic in order to gain the associated advantages during recycling of the plastic. This however does not mean that such a container could not also be a reusable container.

In a conventional container of this kind of which the invention is concerned (EP 004 615 B1), a container aperture having an opening is disposed on the upper wall surface facing the container head and the wall surface is completely covered by a cap-like closure head. A joint hinge constitutes a pivoted coupling and is disposed on a portion of this surface separated from the container aperture for facilitating pivoting away of this cap. A bushing is disposed on the inner side of this cap facing the neck which, when the cap is closed, is clipped over the container aperture to close same. Since both the cap and the container are made from the same plastic material, sorted recycling is possible. The mounting of the cap to the container is primarily advantageous for directed and simple closure with which the bushing can be clipped over the container aperture and, due to the conical shape, connected together.

Container materials can gain entrance to the volume between the container wall surface and the inner side of the lid when the closure head is opened. In addition, depending on production tolerances, the clamping connection causes the container to be difficult to open, particularly since the cap can not be rotated relative to the container due to its connection to same.

A container also known in the art (U.S. Pat. No. 5,358,154) with which a closing element can be moved from an opened into a closed position. A flexible region is thereby provided in the container wall whose thickness is less than that of the other portions of the container wall. This flexible region thereby functions as a hinge to facilitate pivoting of the closing element. This closing element thereby disadvantageously functions merely as a lid closing the container opening and not as a closure head surroundingly engaging the container opening.

SUMMARY OF THE INVENTION

The container closure in accordance with the invention is characterized by an outlet aperture disposed on the closure head next to the closing component and, in addition to the coupling for pivoting the closure head towards the container, an outwardly containing and thereby volume defining foil, wherein, when opening the container, the closing component is removed from the opening and the outlet aperture can be pivoted relative to the opening, whereas, when closing the container, the closure head can be clipped over the opening so that the closing component covers the opening. This has the advantage that the outlet aperture is also disposed on the closure head and, when pivoting for opening, is positioned in front of the neck opening of the container. The volume between this outlet aperture and the container opening, which is defined by the foil, is part of the container volume, since same is directly connected to the inner region of the container when the container is opened. When the container is emptied, the contents thereof go through this volume and through the closure head. The outlet aperture does not change in the outward direction so that, at this outlet aperture, arbitrary guiding means such as tubes and the like can be disposed without thereby inhibiting the function of the container closure.

In accordance with an advantageous embodiment of the invention, the closure head and the container are mutually integral and made from the same plastic. This has particular advantages for manufacture and recycling.

In accordance with an additional advantageous configuration of the invention, the shape of the closure head is formed in the manner of a spherical cap segment (half of a sphere), wherein the opening is ring-shaped and wherein the closure component cooperating with the neck opening has a curved shape extending towards the opening. The spherical shape has the advantage that it approximately conforms to the function of the container closure in accordance with the invention. This is particularly prominent when opening the container, that is to say after pivoting the head in the upward direction. In closing the container, the head is appropriately pivoted to the side to thereby clip over the container aperture. In addition, a spherical member has optimum stability with a minimum amount of material. In addition, the seal between the "ring" and "sphere" is easy to produce in a precise manner, wherein, due to the resulting conical-like sealing configuration between the cooperating components, in the sealing region, a type of wedge seal is produced with which, having the proper desired sealing characteristics, a reduced degree of axially directed forces are necessary compare to a flat seal. The seal can also be effected by means of an undercut on the closure component after same has been snapped into the opening of the container aperture.

In accordance with an additional advantageous configuration of the invention, the outlet aperture, in the closed position of the closure head, is pivoted or clipped over a curvature disposed on the closure head or container to thereby facilitate closure. This curvature can be disposed on the side of the neck of the container and seals the outlet aperture at this location in a manner similar to that of the spherical cap sealing the container aperture. In this fashion, one principally prevents materials present in the closure head from flowing out via the outlet aperture when the closure head is in the closed position.

In accordance with an additional advantageous configuration of the invention, the pivot angle of the cap assumes the value of approximately 78°. This pivot angle can however be substantially varied depending on the size of the outlet aperture, the separation between the outlet aperture and the pivot point of the closure head, and the dimensions of the closure component. If required, a relatively small pivot angle between the closed and opened positions of the closure head is possible without thereby inhibiting the material from flowing out of the container.

In accordance with an additional advantageous configuration of the invention, at least one of the end positions can be locked in a manner similar to that of a snapping connection after pivoting of the closure head. The snapping connection can simultaneously define the pressuring force between the closing component and the opening of the container aperture and the associated sealing pressure between the curvature and the outlet aperture when the container closure is closed. Depending on the shape, associated tensioning forces result in the transitional region, that is to say in the pivoting region in dependence on the shape and elasticity of the foil connecting the closure head and the container.

In accordance with an additional advantageous configuration of the invention, the limiting foil is made from the same plastic material as the closure head. In this manner sorted recycling of the object is achieved.

In an additional configuration of the invention, production is effected using the plastic blowing process, wherein the blowing arbor projects through the neck into the container and the finished product effects the container closure in the opened state. In particular with the container closure in accordance with the invention, this type of manufacturing procedure has advantages, since the construction of the container closure can be effected without undercutting.

Additional advantages and advantageous configurations of the invention can be extracted from the subsequent description, the drawing and the claims.

BRIEF DESCRIPTION OF THE DRAWING

An embodiment of the object of the invention is represented in the drawing and is described more closely below.

DESCRIPTION OF THE PREFERRED EMBODIMENT

Figure 1:
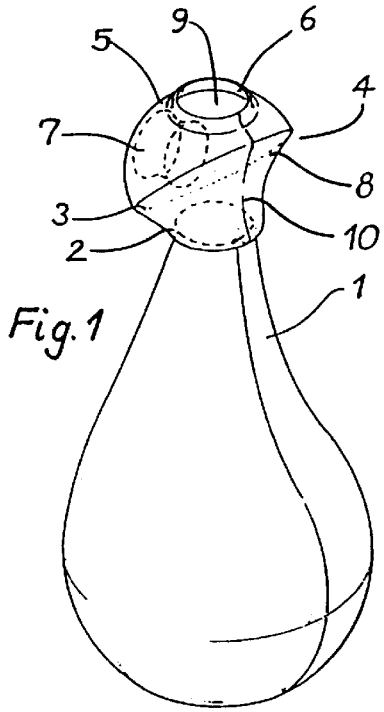
FIG. 1 shows a perspective representation of a bottle with an opened closure.

The perspective view of the bottle shown in FIG. 1 comprises a container 1 having a container aperture with an opening 2, wherein a closure head 4 can pivot via a pivoted coupling 3. The closure head 4 has a semi-spherical cap 5 having an outlet aperture 6 and a closing component 7 on the inner side of the cap 5. A flexible foil 8 is disposed between the cap 5 and the opening 2 which, together with the cap 5, defines a volume 9 between the outlet aperture 6 and the opening 2.

Figure 2:
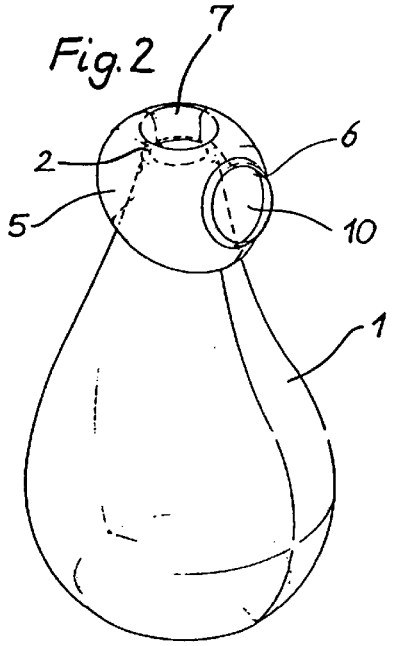
FIG. 2 is the same bottle in the closed state.
Figure 3:
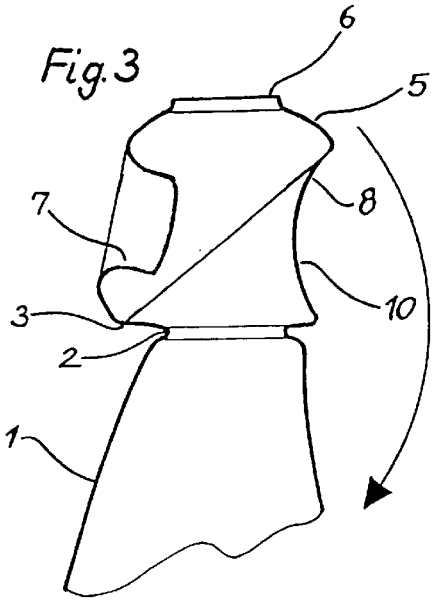
FIG. 3 is a longitudinal cut with an opened closure
Figure 4:
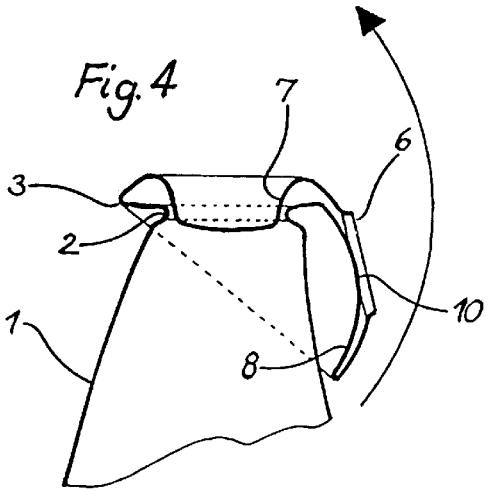
FIG. 4 is the closure in the closed state.

FIG. 2 shows the bottle 1 in a closed state after the cap 5, as more closely described in FIGS. 3 and 4, has been moved about the pivoted coupling 3 in a downward direction to thereby clip over the container aperture. The outlet aperture 6 then faces in a sideward direction, wherein the capped-shaped inwardly disposed closing component 7 on the upper edge seats on the opening 2 to thereby seal the bottle 1. The outlet aperture 6, which is likewise disposed on the cap 5, is contained by the curvature formed by a foil 8 so that materials which may remain in the volume 9 after pouring cannot escape to the outside.

The more detailed functioning of the opening and closing of the container closure in accordance with the invention is shown in FIGS. 3 and 4. The cap 5 can be moved about the pivoted coupling 3 to assume a final position in FIG. 3 in which the closing component 7 is pivoted away from the container aperture to thereby free the outlet aperture 6, whereas in the closed position of the closure head 4 shown in FIG. 4, the closing component 7 seats on the opening 2 to thereby close same. The outlet aperture 6, which is appropriately pivoted to the side from the upward into the downward direction, is sealed by the curvature 10.

All the features disclosed in the description, the subsequent claims, as well as in the drawing can be pertinent to the invention individually or collectively in arbitrary combination.

List of Reference Symbols

1 container
2 opening
3 pivoted coupling (for clipping)
4 closure head
5 cap
6 outlet aperture
7 closing component
8 foil
9 volume
10 curvature

We claim:

1. A closure for sealing an opening of a container, the container for holding liquids, cremes, or pourable materials, the closure comprising:

a closure head having an outlet aperture;

a closing component disposed on an inner side of said closure head;

a foil disposed between the container opening and the outlet aperture; and a pivoted coupling disposed between said outlet aperture and said foil for joining said foil and said closure head, wherein, when closing the container, the foil folds inwardly from the pivoted coupling, the closure head rotates downwardly and sideward to locate said outlet aperture at an upper outer side of the container next to the opening, and said closing component rotates downwardly to seat on the opening and seal the container.

2. The closure of claim 1, wherein said closure head is integral with and made from the same material as the container.

3. The closure of claim 1, wherein the opening is ring shaped, the closure head has a semi-spherical shape, and said closing component bulges out from an inner surface of said closure head.

4. The closure of claim 1, wherein an inner side of said foil seats on said outlet aperture when said closing component seals the opening.

5. The closure of claim 1, wherein said closing component pivots through an angle of approximately 80° to seal the opening.

6. The closure of claim 1, wherein said closure head has an internal volume which is reduced when the container is sealed.

7. The closure of claim 1, wherein at least one of said closure head, said pivoted coupling and said foil have a stiffness and elasticity for snapping and locking said closure.

8. The closure of claim 1, wherein said foil and said closure head are made from a same plastic material.

9. A closure for sealing a ring-shaped opening of a container, the container for holding liquids, cremes, or pourable materials, the closure comprising:

a semi-spherical closure head having an outlet aperture;

a closing component disposed on and bulging out from an inner surface of said closure head; a foil disposed between the container opening and the outlet aperture; and a pivoted coupling disposed between said outlet aperture and said foil for joining said foil and said closure head.

10. A closure for sealing an opening of a container, the container for holding liquids, cremes, or pourable materials, the closure comprising:

a closure head having an outlet aperture;

a closing component disposed on an inner side of said closure head;

a foil disposed between the container opening and the outlet aperture; and a pivoted coupling disposed between said outlet aperture and said foil for joining said foil and said closure head, wherein an inner side of said foil seats on said outlet aperture when said closing component seals the opening.

11. A closure for sealing an opening of a container, the container for holding liquids, cremes, or pourable materials, the closure comprising:

a closure head having an outlet aperture;

a closing component disposed on an inner side of said closure head;

a foil disposed between the container opening and the outlet aperture; and a pivoted coupling disposed between said outlet aperture and said foil for joining said foil and said closure head, wherein said closing component pivots through an angle of approximately 80° to seal the opening.

* * * * *